US005555983A

United States Patent [19]

Yamagishi

[11] Patent Number: 5,555,983

[45] Date of Patent: Sep. 17, 1996

[54] CASH TRANSACTION APPARATUS

[75] Inventor: Satoru Yamagishi, Kawasaki, Japan

[73] Assignee: Kabushiki Kaisha Toshiba, Kawasaki, Japan

[21] Appl. No.: 309,690

[22] Filed: Sep. 21, 1994

[30] Foreign Application Priority Data

Sep. 21, 1993 [JP] Japan ..... 5-235163

[51] Int. Cl.[6] ..... B07C 5/00

[52] U.S. Cl. ..... 209/534

[58] Field of Search ..... 209/534; 235/425, 235/379

[56] References Cited

U.S. PATENT DOCUMENTS

| | | | |
|---|---|---|---|
| 4,825,378 | 4/1989 | Yuge | 209/534 X |
| 4,905,840 | 3/1990 | Yuge et al. | 209/534 |
| 5,000,322 | 3/1991 | Goi | 209/534 |
| 5,135,212 | 8/1992 | Utsumi et al. | 209/534 X |
| 5,468,941 | 11/1995 | Sasaki | 209/534 X |

*Primary Examiner*—David H. Bollinger

*Attorney, Agent, or Firm*—Cushman Darby & Cushman, L.L.P.

[57] ABSTRACT

A cash transaction apparatus includes a plurality of storage safes for storing banknotes for each denomination. Each of the storage safes has a temporary stacking section for temporarily and removably stacking the banknotes, and a receiving section for receiving the banknotes from the temporary stacking section. Upon collecting the banknotes from at least one designated storage safe, the banknotes of the storage safe are supplied from its corresponding receiving section to an inspecting section through a dispensing-banknote conveying path, and counted therein. After that, the banknotes are stacked in a temporary stacking section corresponding to the designated storage safe, and then removed therefrom by an operator.

6 Claims, 6 Drawing Sheets

CASH TRANSACTION APPARATUS

BACKGROUND OF THE INVENTION

1. Field of the Invention

The present invention relates to a cash transaction apparatus, installed in a banking agency and the like, for automatically performing cash transactions such as receipt/payment of bank notes.

2. Description of the Related Art

Cash transaction apparatuses for automatically performing cash transactions, such as receiving and dispensing bank notes in accordance with the operation of a bank clerk, have recently been installed in many banking agencies such as a bank. For example, a receiving/dispensing recycling machine having a bundling machine is known as one cash transaction apparatus. The recycling machine receives the banknotes collected by an automatic teller machine (ATM) for automatically receiving/dispensing money from/to customers, and uses the collected banknotes as part of banknotes for dispensing upon withdrawal.

A receiving/dispensing recycling machine usually includes a plurality of storage safes. The banknotes received in a receiving opening of the machine, are inspecting section to discriminate their denominations, damaged/undamaged state, authenticity, etc., and then stored in the storage safes according to the denominations. In a dispensing operation, banknotes are taken out from predetermined storage safes, discriminated based on their denominations, counted at a dispensing side inspecting section, and discharged from a dispensing opening. In the latter case, the banknotes, which cannot be inspected or counted because they overlap each other or the like, are rejected and stored in a dispensing banknote reject safe provided near the dispensing opening.

The banknotes in the recycling machine are collected whenever a predetermined period of time elapses, and the amount of the collected banknotes are compared with management data stored separately. The general methods of collecting the banknotes are as follows: When each of the storage safes is detachable from the machine, the storage safes are detached from the machine, and the banknotes are taken out of the safes and inserted into the recycling machine again, for counting when the storage safes are undetachable, only the banknotes are removed from the safes and supplied to the machine, for counting.

According to the above-mentioned methods of collection, however, after the banknotes are removed from the recycling machine, they are put into the recycling machine again for counting and then removed again therefrom. For this reason, the methods are complicated, and may cause an error in operation and take a lot of time.

Upon collecting operation, if an operator leaves some of banknotes in the recycling machine carelessly, or if an operator loses some of banknotes to be inserted into the recycling machine, the counting result of collected banknotes does not coincide with management data, and the number of banknotes which have been stored in the storage safes cannot be determined correctly. It is uncertain whether the noncoincidence is caused by rejected banknotes or other reasons. In this case, it is necessary to perform an operation of collecting the dispensing reject safe and counting the number of rejected banknotes for each denomination.

The recycling machine is generally capable of dispensing about 100 banknotes at once. To dispense banknotes more than 100, 100 banknotes are discharged from the outlet and removed therefrom, and then the remaining banknotes are discharged. It is therefore necessary to repeat the discharge and removal operations a plurality of times in order to pay out several hundreds of banknotes or several thousands of banknotes, resulting in requiring a lot of time to pay out money.

SUMMARY OF THE INVENTION

The present invention has been contrived in consideration of the above circumstances, and its object is to provide a cash transaction apparatus capable of easily and quickly collecting banknotes stored in a safe and dispensing a great deal of banknotes for a short time.

To attain the above object, a cash transaction apparatus according to one aspect of the present invention comprises: a plurality of temporary stacking sections for temporarily stacking received banknotes to be removable from outside the stacking sections; a plurality of receiving sections for receiving the banknotes from the respective temporary stacking sections and storing the banknotes therein; instructing means for instructing collection of the banknotes stored in a designated receiving section; collecting/conveying means for, when the collection of the banknotes is instructed, taking the banknotes out of the designated receiving section and stacking the banknote one of the plurality of temporary stacking sections; and counting means for counting the banknotes collected by the collection-transfer means.

With the cash transaction apparatus, in order to collect the banknotes from a desired receiving section, the banknotes are removed from the receiving section by the collecting/conveying means, and counted by the counting means. The banknotes are then carried and stacked in at least one of the temporary stacking sections. The number of banknotes stacked in this temporary stacking section is determined by the counting means. Then, these banknotes are removed from the stacking section, thus completing the collecting operation.

According to the above cash transaction apparatus, the collecting operation is completed by removing the banknotes the number of which is previously counted and determined, from the apparatus. Therefore, even when rejected banknotes remain in a reject safe, the number of the removed banknotes can be obtained correctly, without counting the number of the rejected banknotes.

It is thus unnecessary to recount the banknotes or collect the reject safe, and it is possible to simplify the operations, prevent a wrong operation, and shorten the transaction time. Furthermore, since an operator does not have to perform any manual operations until the collected banknotes are counted, an error can be prevented from occurring, with the result that the number of banknotes can be counted correctly.

A cash transaction apparatus according to another aspect of the present invention comprises: a plurality of temporary stacking sections for temporarily stacking received banknotes for each denomination, to be removable from the stacking sections; a plurality of receiving sections corresponding to the plurality of temporary stacking sections, for receiving the banknotes from the temporary stacking sections and storing the banknotes therein; dispensing banknote conveying for taking the banknotes out of the plurality of receiving sections and dispensing the banknotes to the outside of the apparatus; conveying means branching from the dispensing-banknote conveying means, for conveying the banknotes taken out of the plurality of receiving sections to the plurality of temporary stacking sections; a dispensing-banknote stacking section having a predetermined capacity, for stacking the banknotes dispensed by the dispensing-banknote conveying means; instructing means for instructing the number of banknotes to be dispensed; detecting means for detecting that the instructed number is larger than the capacity of the of the dispensing-banknote stacking section or not; and selecting means for, when the instructed number of banknotes to be dispensed is smaller than the capacity of the dispensing-banknote stacking section, stacking the banknotes taken out of the receiving sections in the dispensing-banknote stacking section, and for, when the instructed number of banknotes to be dispensed is larger than the capacity of the dispensing-banknote stacking section, stacking the banknotes taken out of the receiving sections in the temporary stacking sections through the conveying means.

With the cash transaction apparatus constructed as described above, when the banknotes over the capacity of the dispensing-banknote stacking section are to be dispensed, they are stacked in at least one temporary stacking section by the dispensing-banknote conveying means and conveying means. When the number of banknotes stacked in the temporary stacking section amounts to a predetermined value, they are taken out therefrom by an operator and paid out.

As described above, when a large amount of banknotes over the capacity of the dispensing-banknote stacking section is to be dispensed, the temporary stacking sections can be used as additional or auxiliary dispensing-banknote stacking section. Therefore, it is not necessary to confirm or wait for the removal of the banknotes to be dispensed, and the time required for the dispensing transaction can be shortened.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 9 show a cash transaction apparatus according to an embodiment of the present invention, in which:

FIG. 1 is a perspective view showing the entire construction of the cash transaction apparatus;

FIG. 2 is a sectional view schematically showing a receiving/dispensing recycling machine and a bundling machine of the apparatus, FIGS. 3 and 4 are flow charts showing a banknote collecting operation of the recycling machine;

FIG. 5 is a plan view showing a display screen in the banknote collecting operation;

FIG. 6 is a schematic view showing a flow of banknotes in a collecting operation performed in a collection mode of setting 1 of the recycling machine;

FIG. 7 is a schematic view showing a flow of banknotes in a collecting operation for collecting damaged banknotes from a damaged-banknote safe; and FIGS. 8 and 9 are schematic views each showing a flow of banknotes in a collecting operation performed in a collection mode of setting 2 of the recycling machine.

DETAILED DESCRIPTION OF THE PREFERRED EMBODIMENTS

A cash transaction apparatus according to an embodiment of the present invention will now be described in detail with reference to the accompanying drawings.

Figure 1:
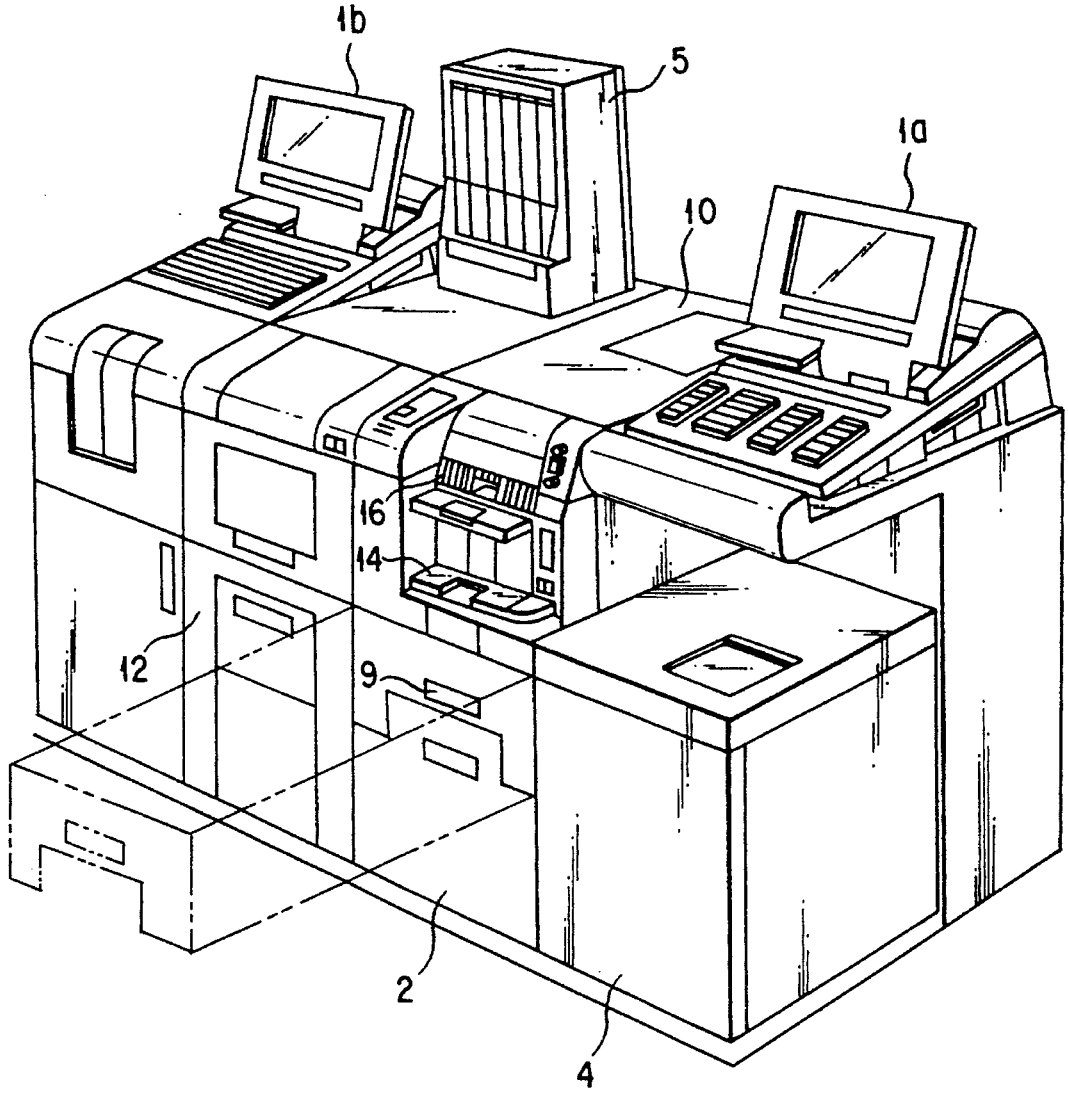

As shown in FIG. 1, the cash transaction apparatus includes two teller machines 1*a* and 1*b*, for controlling the operation of the apparatus and processing data, a receiving/dispensing recycling machine 10 for receiving banknotes and dispensing some of the received banknotes, and a bundling machine 12 connected to the recycling machine 10, for bundling the banknotes every predetermined number. Further, the apparatus includes a coin receiving machine 4, and a coin dispensing machine 5.

Figure 2:
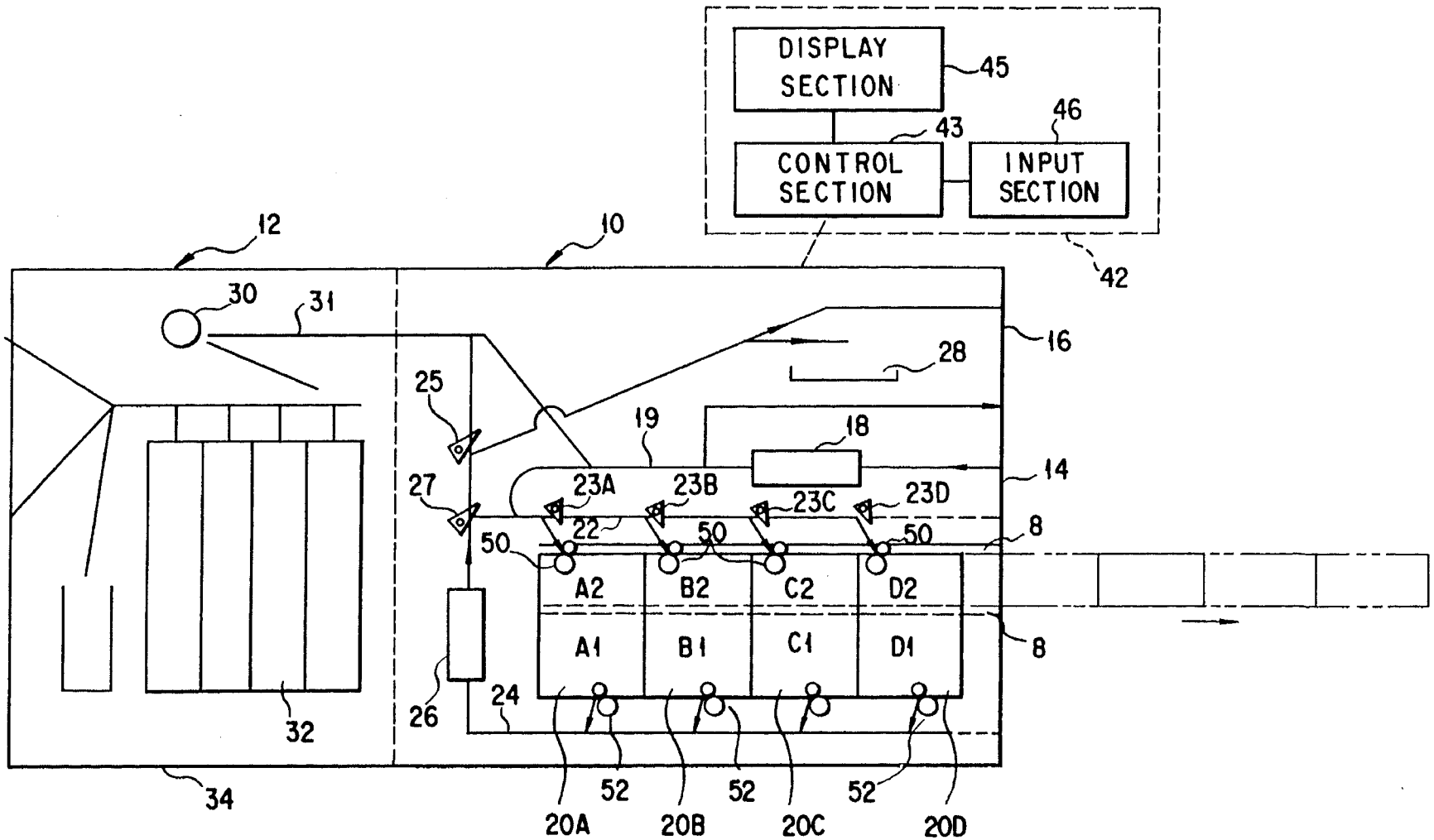

As shown in FIG. 2, the recycling machine 10 is provided with a receiving opening 14 for receiving banknotes at once and a dispensing opening 16, serving as a dispensing-banknote stacking section which has a predetermined capacity, e.g., which is capable of dispensing 100 banknotes at once. The receiving and dispensing openings 14 and 16 are provided at a front face of the machine 10 The recycling machine 10 includes a plurality of storage safes 20A to 20D arranged in line.

The storage safes 20A to 20D have their respective receiving sections A1 to D1 for storing banknotes and their respective temporary stacking sections A2 to D2 for temporarily stacking banknotes to be externally removable therefrom. Each of the storage safes is so constituted that, when the number of banknotes stacked in the temporary stacking section amounts to a predetermined value, they are transferred to its receiving section. Each temporary stacking section is capable of stacking about 600 banknotes, and each receiving section is capable of storing about 2000 banknotes.

The temporary stacking sections A2 to D2 are connected to one another and are supported by guide rails 8 to be slidable along the rails. As shown in FIG. 1, a door 9 is formed in the front face of the machine 10. By hooking a hand to the door 9 and pulling it, the temporary stacking sections A2 to D2 can be drawn out of the machine 10, as shown by two dots and dashed line in FIGS. 1 and 2. Thus, banknotes stored in the temporary stacking section or sections can be externally removable therefrom.

Of the storage safes, for example, the storage safe 20D serves as a damaged-banknote storage safe for storing damaged banknotes with dirt, a tear, or the like, which are unfit for reuse as payment banknotes. The other storage safes 20A, 20B and 20C serve as safes for storing banknotes fit for reuse, according to their denominations. For example, ¥10000 banknotes are stacked in the storage safes 20A and 20B, and ¥1000 banknotes are stacked in the storage safe 20C.

The receiving opening 14 is connected to the temporary stacking sections A2 to D2 of the storage safes 20A to 20D through a received-banknote conveying path 19 and a count carrying path 22. In the received-banknote conveying path 19 is arranged a receiving side inspection section 18 for inspecting the denominations of received banknotes, checking whether they are damaged or undamaged and whether they are true or false, and the like and serving as counting means for counting the banknotes. In the conveying path 22 are arranged a plurality of distributing gates 23A, 23B and 23C for distributing the banknotes inspected by the inspection section 18 to the storage safes 20A, 20B and 20C corresponding to the denominations and a distributing gate 23D for distributing the damaged banknotes to the storage safe 20D.

The dispensing opening 16 is connected to the receiving sections A1 to D1 of the storage safes 20A to 20D through a dispensing-banknote conveying path 24. The conveying path 24 is provided with a dispensing side inspection section 26 Serving as discriminating means for discriminating the denominations of the banknotes removed from the storage safes 20A to 20D, determining whether the banknotes are damaged or undamaged, and counting them. In the conveying path 24 are arranged a first distributing gate 27 for distributing the banknotes passed through the inspection section 26 to the conveying path 22 and a second distributing gate 25 for distributing the banknotes to the dispensing opening 16 or the bundling machine 12. Furthermore, the conveying path 24 is connected to a reject safe 28 for receiving rejected banknotes, in the vicinity of the dispensing opening 16.

A number of feed rollers and a convey belt are arranged in each of the conveying paths 19, 22, and 24. In each of the temporary stacking sections A2 to D2 is arranged a take-in mechanism 50 for taking the banknotes sent via the conveying path 22 into the stacking section. In each of the storing sections A1 to D1 is arranged a take-out mechanism 52 for taking out the banknotes from the storing section and sending them to the conveying path 24. The conveying path 24 and take-out mechanism 52 constitute dispensing banknote conveying means of the present invention, and the conveying path 22 and take-in mechanism 50 constitute carrying means of the present invention. Further, the conveying paths 22 and 24, take-out mechanism 52, and take-in mechanism 50 constitute collecting/conveying means of the present invention.

The bundling machine 12 includes a bundling section 30 for bundling the banknotes, which are supplied from the received-banknote convey path 19 or dispensing-banknote convey path 24 through a bundling convey path 31 serving as third conveying means, every predetermined number, a plurality of temporary storing sections 32 for temporary storing bundles of banknotes, and a discharge port 34 for discharging the bundles of banknotes.

An operation unit constituting designation means and instructing means is connected to the receiving/ dispensing recycling machine 10. The operation unit 42 includes a control section 43 for controlling operations of the recycling machine 10 and bundling machine 12, a display section 45 for displaying various information on the operation state of the apparatus, etc., and an input section 46 for inputting various pieces of data about transaction items, the amount of money received, the amount of money dispensed, and operation modes such as the collecting operation, and the like.

An operation of the cash transaction apparatus having the above-mentioned constitution will now be described.

In the normal receipt transaction, when banknotes are inserted into the receiving opening 14 at once, they are carried to the receiving side inspection section 18 through the conveying path 19. The inspection section 18 counts the received banknotes, determining the denominations of the received banknotes, and discriminating whether they are damaged or undamaged and whether they are true or false. The banknotes are then sent to the convey path 22, and distributed by the distributing gates 23A to 23C to the storage safes 20A to 20C in accordance with their denominations. The banknotes distributed according to the denominations are taken in the corresponding one of the temporary stacking sections A2 to C2 by the take-in mechanism 50 and stacked therein. The banknotes discriminated as damaged banknotes by the inspection section 18, are distributed to the storage safe 20D by the distributing gate 23D and stacked in the temporary stacking section D2. In each storage safe, as a predetermined number of banknotes are stacked in the temporary stacking section, they are automatically transferred to the receiving section.

In the dispensing transaction, when a desired amount of money to be dispensed is input through the operation unit 42, the predetermined number of banknotes are taken out of at least one of the receiving sections A1 to C1 of the storage safes 20A to 20C, and fed to the dispensing side inspection section 26 through the conveying path 24. After the banknotes are counted and their denominations are checked by the inspection section 26, they are fed to the dispensing opening 16 by the second distributing gate 25. Rejected banknotes, e.g., the overlapped banknotes, which cannot be inspected by the inspection section 26, are fed to the reject safe 28 and stacked therein.

In the dispensing transaction, the banknotes corresponding to a predetermined denomination designated by the operation unit 42 can be bundled by the bundling section 30 every predetermined number and discharged from the discharge port 34.

Whenever a predetermined period of time elapses, a collecting operation is performed, wherein the banknotes are collected from the storage safes 20A to 20D in order to count the banknotes contained in the recycling machine 10. This collecting operation will now be described.

Figure 3:
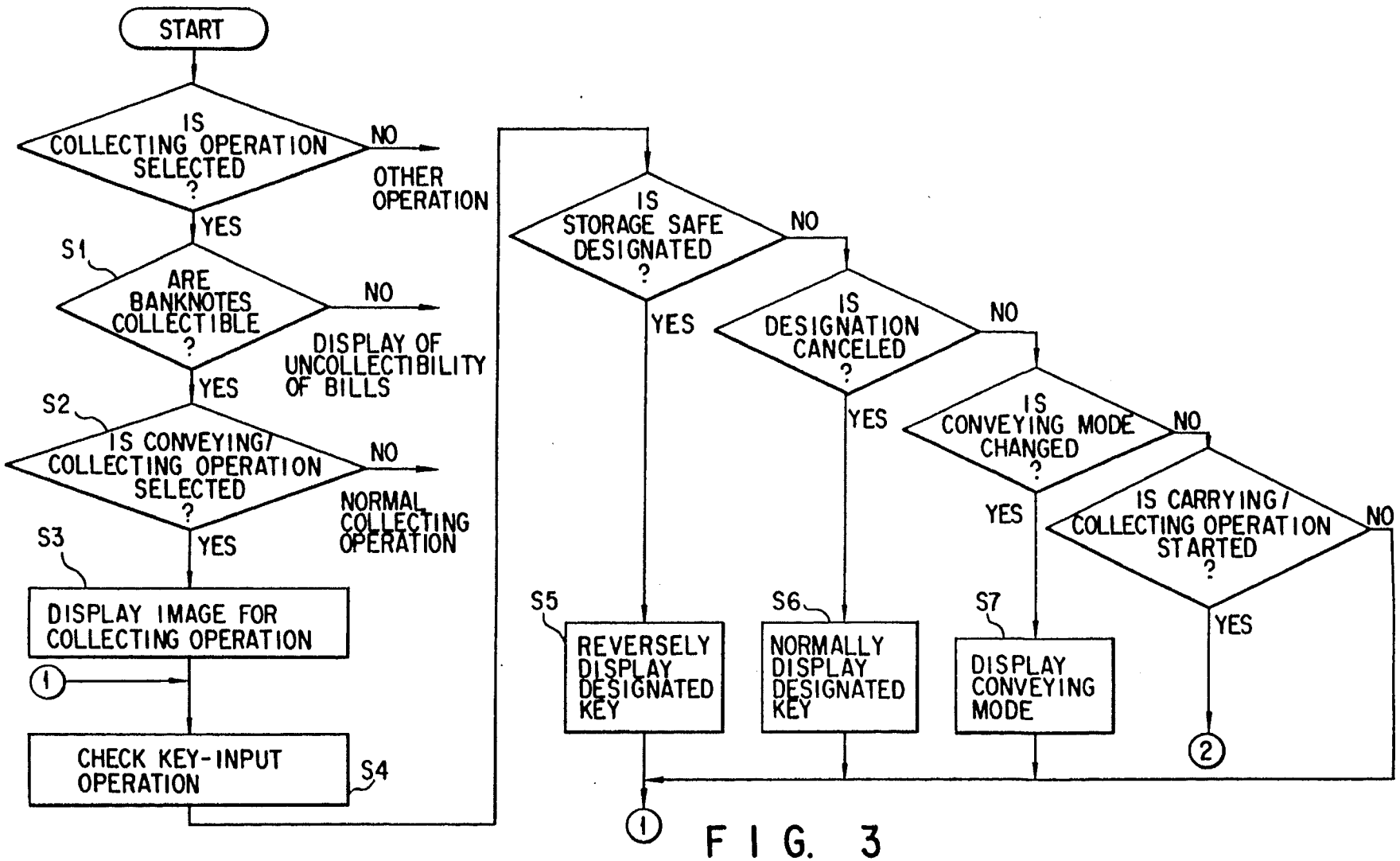
Figure 4:
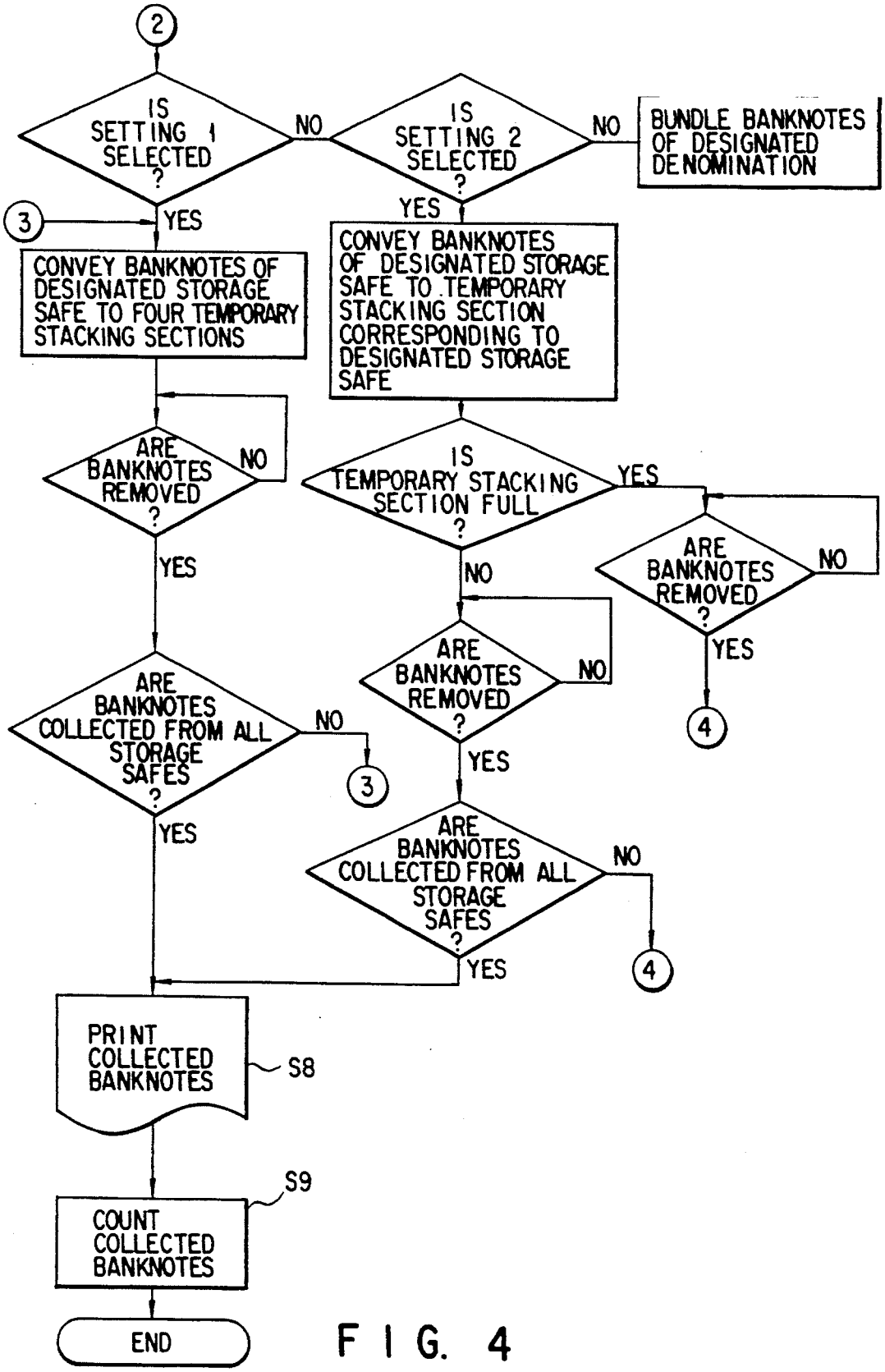
Figure 5:
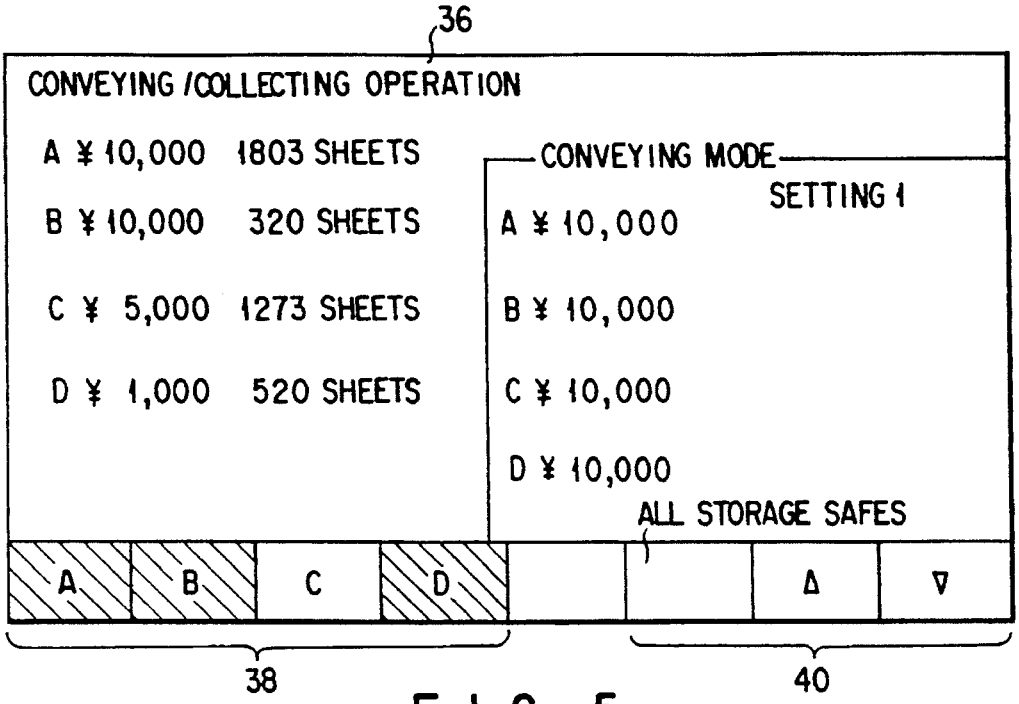

As shown in FIGS. 3 and 4, when a banknote collecting operation is selected by the input section 46 of the operation unit 42, the control section 43 detects whether the recycling machine 10 is in a state capable of performing a collecting operation (step S1). During the dispensing or receiving transaction of the recycling machine 10, the control section 43 detects that the recycling machine 10 is unable to perform a collecting operation, and displays in the display section 45 of the operation unit 42 information that no banknotes can be collected. In a state wherein the banknotes can be collected, if a convey/collection mode, described later, different from the conventional technique of exchanging safes is selected (step S2), the control section 43 causes the display section 45 to display a picture screen 36 for banknote collection (step S3), as shown in FIG. 5, and monitors an input operation performed through the picture screen (step S4).

The picture screen 36 shows designation keys 38 for designating the storage safes to be collected, selection keys 40 for selecting a conveying mode, and the like. A bundling operation can also be designated from the picture screen simultaneously with the collecting operation. If one storage safe to be collected is designated through the picture screen 36, the designation key 38 indicating the storage safe is reversely displayed (step S5), and the other designation keys indicating non-designated storage safes are normally displayed. When the reversely displayed designation key 38 is depressed again, it is determined that the designation is canceled, and the reverse display of the key 38 is changed to the normal one (step S6).

Figure 6:
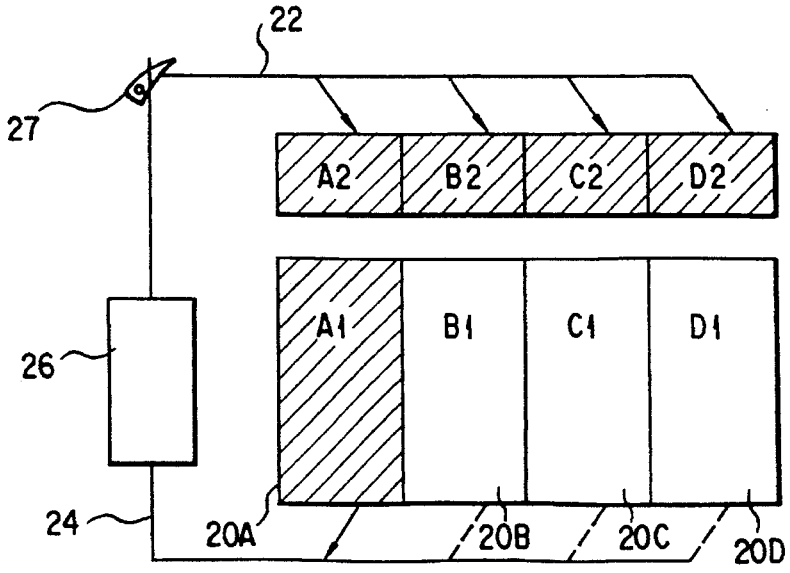
Figure 8:
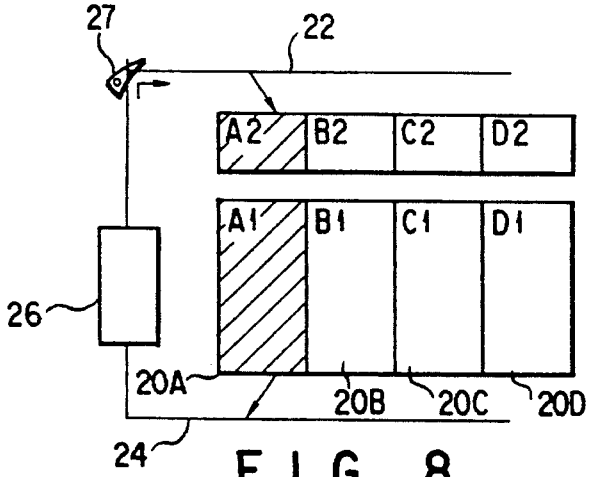
Figure 9:
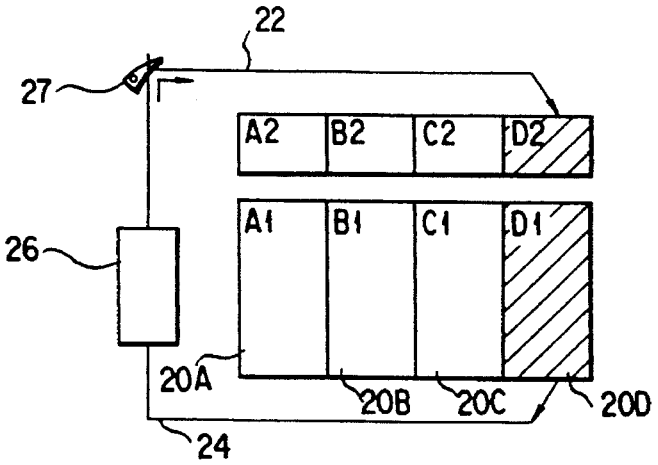

The conveying mode can be selectively set to setting 1 for conveying all the banknotes in one storage safe to the four temporary stacking sections A2 to D2, as shown in FIGS. 6 and 7, setting 2 for conveying the banknotes in the storage safes to their respective temporary stacking sections, as shown in FIGS. 8 and 9, and setting 3 for conveying the banknotes of a specific denomination to the bundling machine 12 to bundle them and conveying the banknotes of the other denominations to the temporary stacking sections (step S7).

If a "start" key is depressed after the selection of a storage safe and that of a conveying mode are completed, the conveying/collecting operation is started. When the setting 1 is selected as a conveying mode, as shown in FIG. 6, for example, the banknotes are taken out of the receiving section A1 of a designated storage safe 20A by the take-out mechanism 52, and fed to the dispensing side, inspection section 26 through the conveying path 24. The banknotes are counted by the section 26 and then guided to the conveying path 22 by the first distributing gate 27. Then, the banknotes are stacked in the temporary stacking sections A2, B2, C2 and D2 in this order.

When all the banknotes of the receiving section A1 of the storage safe 20A are stacked in the temporary stacking sections A2 to D2, these stacking sections can be detached, resulting in a waiting state for removing the banknotes. After the banknotes are removed and the temporary stacking sections are reset in the storage safes, the banknotes can be collected from the receiving section of the next storage safe. When the collection of banknotes of all the designated storage safes is completed, the number of banknotes of each storage safe counted by the inspection section 26 during the collecting step is printed and added as collection data, and the collecting operation is completed (steps $8 and S9).

Figure 7:
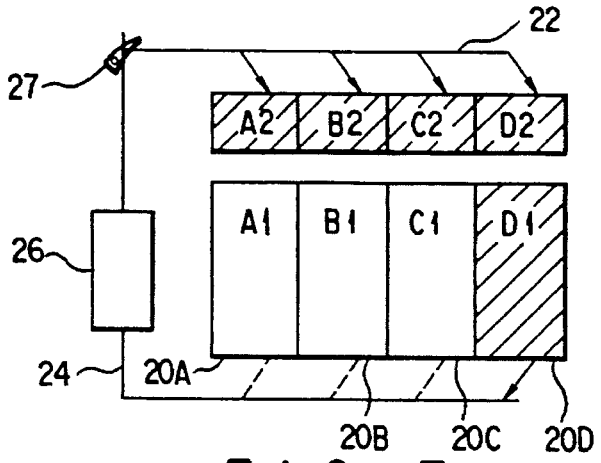

The storage safe 20D serving as a damaged-banknote storage safe contains banknotes of various denominations. Upon a conveying/collecting operation for the banknotes in the storage safe 20D, as shown in FIG. 7, after the banknotes removed from the receiving section D1 are counted and their denominations are discriminated by the inspection section 26, they can be separately stacked in the temporary stacking sections A2 to D2 according to the denominations.

when the setting 2 is selected as a conveying mode, as shown in FIG. 8, for example, the banknotes are taken out of the receiving section A1 of a designated storage safe 20A, counted by the inspection section 26, and stacked in the temporary stacking section A2 through the distributing gate 27 and conveying path 22. Subsequently, the same transaction as described above is executed for the another designated storage safe 20D, as shown in FIG. 9, and then the banknotes are collected from the temporary stacking sections A2 and D2 by an operator.

In the setting 2, there is a case where a temporary stacking section is filled with banknotes and the collecting operation is stopped on the way. In this case, the collecting operation is restarted after the banknotes are removed from at least the banknote-filled temporary stacking section. Upon completing the collection of banknotes from all the designated storage safes, the numbers of banknotes in the storage safes, which are counted by the inspection section 26 during the collecting operation, are printed and added as collection data in the banknote collection process described above, and the collecting operation is completed (steps S8 and S9).

The setting 2 is selected in the case where, when the number of banknotes stored in each storage safe is small and two or more storage safes are designated, the removal of banknotes from the temporary stacking section of the storage safe can be completed once or twice.

To perform the collecting operation using the bundling machine 12, the banknotes taken out of the storage safe corresponding to a designated denomination, are counted by the dispensing side inspection section 26, and guided to the bundling machine 12 via the first and second distributing gates 27 and 25 and bundling conveying path 31. The banknotes are bundled by the bundling section 30 into a plurality of small bundles each including a predetermined number of banknotes, and the bundles are discharged from the discharge port 34. When a storage safe storing the banknotes of another denomination is designated at the same time, the banknotes are counted by the inspection section 26 and stacked in the temporary stacking section.

If a large amount of banknotes over the capacity of the dispensing opening 16 are to be dispensed, the same operation as in the case of the setting 1 is performed. More specifically, the banknotes taken out of a predetermined storage Safe are counted by the inspection section 26 and then stacked in a plurality of temporary stacking sections through the first distributing gate 27 and conveying path 22. After that, an operator removes the banknotes from the temporary stacking sections to collect a desired amour it of banknotes. By substituting the plural temporary stacking section for the dispensing opening 16, a large number of banknotes can be dispensed for a short time.

According to the cash transaction apparatus having the above-mentioned construction, in the collecting operation, the banknotes taken out of a designated storage safe are counted in advance by the dispensing side inspection section 26, stacked in the temporary stacking section or sections, and then removed from the stacking section or sections by an operator to collect the banknotes. Since the collected banknotes have already been counted and the number of which have been determined, they need not be inserted into the apparatus again for counting, unlike the conventional apparatus. It is therefore unnecessary to carry out an operation of removing the banknotes from the apparatus for counting and returning them thereto by hand, with the result that the collecting operation can be simplified and the collecting time can be shortened. Furthermore, an error due to a manual operation can be prevented, thereby correctly determining the number of collected banknotes.

Further, according to the cash transaction apparatus of the present invention, when a large number of banknotes over the capacity of the dispensing opening 16 are to be dispensed, the banknotes are supplied from the storage safes to the inspection section 26 and counted therein, and then stacked in the temporary stacking section of at least one of the storage safes. When the number of banknotes stacked in the temporary stacking section amounts to a predetermined value, an operator can remove the banknotes therefrom. Since the temporary stacking section is therefore substituted for the dispensing opening, even when a large amount of banknotes are dispensed, it is not necessary to confirm or wait for the removal of the banknotes to be dispensed, and the time required for the dispensing transaction can be shortened.

The present invention is not limited to the above embodiments. Various Changes and modifications can be made without departing from the scope of the invention. In the above embodiment, the banknotes taken out of the storage safes are stacked in one or more temporary stacking sections until the sections are filled with the banknotes. However, the banknotes taken out of the storage safes may be grouped every predetermined number, e.g., 100 banknotes and 200 banknotes, and stacked in the respective temporary stacking sections, thereby collecting the grouped banknotes.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A cash transaction apparatus comprising:

a plurality of temporary stacking sections for temporarily stacking received banknotes that are to be externally removed from the temporary stacking sections, the temporary stacking sections each including a damaged-banknote temporary stacking section for temporarily stacking damaged banknotes;

a plurality of receiving sections for receiving the banknotes from the respective temporary stacking sections and for storing the banknotes therein, the receiving sections each including a damaged-banknote receiving section for receiving the damaged banknotes from the damaged-banknote temporary stacking section and for storing the damaged banknotes therein;

first discriminating means for discriminating denominations and damaged states of the banknotes received and for counting the banknotes received;

first distributing means for distributing the banknotes discriminated by the first discriminating means to the plurality of the temporary stacking sections in accordance with the denominations and damaged states;

instructing means for instructing collection of the banknotes stored in a designate one of the receiving sections;

collecting/conveying means for removing the banknotes from the designated receiving section and for conveying the removed banknotes to the plurality of temporary stacking sections;

second discriminating means for discriminating denominations of the removed banknotes and for counting the removed banknotes; and second distributing means for distributing the removed banknotes to the temporary stacking sections in accordance with the denominates by the second discriminating means.

2. An apparatus according to claim 1, which further comprises:

bundling means for bundling the banknotes;

designating means for designating a denomination of banknotes to be bundled; and bundling-banknote conveying means for conveying the banknotes whose denomination is designated to the bundling means.

3. A cash transaction apparatus comprising:

a plurality of temporary stacking sections for temporarily stacking received banknotes for each denomination to be externally removable from the temporary stacking sections;

a plurality of receiving sections for receiving the banknotes from the respective temporary stacking sections and storing the banknotes therein;

dispensing-banknote conveying means for taking the banknotes out of the plurality of receiving sections and dispensing the banknotes out of the apparatus;

conveying means for conveying the banknotes taken out of the receiving sections to the plurality of temporary stacking sections;

a dispensing-banknote stacking section having a predetermined capacity for stacking the banknotes conveyed by the dispensing-banknote conveying means;

instructing means for instructing the number of banknotes to be dispensed;

detecting means for detecting whether the instructed number is larger than the capacity of the dispensing-banknote stacking section; and selecting means for, when the instructed number of banknotes to be dispensed is smaller than the capacity of the dispensing-banknote stacking section, stacking the banknotes taken out of the receiving sections in the dispensing-banknote stacking section, and for, when the instructed number of banknotes to be dispensed is larger than the capacity of the dispensing-banknote stacking section, stacking the banknotes taken out of the receiving section in at least one of the temporary stacking sections through the conveying means.

4. A cash transaction apparatus comprising:

a plurality of temporary stacking sections for temporarily stacking received banknotes to be externally removed from the temporary stacking sections, the temporary stacking sections each including a damaged-banknote temporary stacking section for temporarily stacking damaged banknotes;

a plurality of receiving sections for receiving the banknotes from the respective temporary stacking sections and for storing the banknotes therein, the receiving sections each including a damaged-banknote receiving section for receiving the damaged banknotes from the damaged-banknote temporary stacking section and for storing the damaged banknotes therein;

a first discriminator for discriminating denominations and damaged states of the banknotes received and for counting the banknotes received;

a first distributor for distributing the banknotes discriminated by the first discriminator to the plurality of the temporary stacking sections in accordance with the denominations and damaged states;

an instructing device for instructing collection of the banknotes stored in a designate one of the receiving sections;

a collecting/conveying device for removing the banknotes from the designated receiving section and for conveying the removed banknotes to the plurality of temporary stacking sections;

a second discriminator for discriminating denominations of the removed banknotes and for counting the removed banknotes; and a second distributor for distributing the removed banknotes to the temporary stacking sections in accordance with the denominates by the second discriminator.

5. An apparatus according to claim 4, which further comprises:

a bundler for bundling the banknotes;

a designating device for designating a denomination of banknotes to be bundled; and a bundling-banknote conveying mechanism for conveying the banknotes whose denomination is designated to the bundler.

6. A cash transaction apparatus comprising:

a plurality of temporary stacking sections for temporarily stacking received banknotes for each denomination to be externally removable from the temporary stacking sections;

a plurality of receiving sections for receiving the banknotes from the respective temporary stacking sections and storing the banknotes therein;

a dispensing-banknote conveying mechanism for taking the banknotes out of the plurality of receiving sections and dispensing the banknotes out of the apparatus;

a conveying mechanism for conveying the banknotes taken out of the receiving sections to the plurality of temporary stacking sections;

a dispensing-banknote stacking section having a predetermined capacity, for stacking the banknotes conveyed by the dispensing-banknote conveying mechanism;

an instructing device for instructing the number of banknotes to be dispensed;

a detecting mechanism for detecting whether the instructed number is larger than the capacity of the dispensing-banknote stacking section; and a selecting mechanism for stacking the banknotes taken out of the receiving sections in the dispensing-banknote stacking section when the instructed member of banknotes to be dispensed is smaller than the capacity of the dispensing-banknote stacking section, and for stacking the banknotes taken out of the receiving section in at least one of the temporary stacking sections through the conveying mechanism when the instructed number of banknotes to be dispensed is larger than the capacity of the dispensing-banknote stacking section.

* * * * *